US008133045B2

(12) United States Patent
Featherstone

(10) Patent No.: US 8,133,045 B2
(45) Date of Patent: Mar. 13, 2012

(54) SELF-ALIGNING PUMP ROTOR AND METHODS

(75) Inventor: Dustin Featherstone, Taylors Falls, MN (US)

(73) Assignee: Delavan Ag Pumps, Inc., Minneapolis, MN (US)

( * ) Notice: Subject to any disclaimer, the term of this patent is extended or adjusted under 35 U.S.C. 154(b) by 685 days.

(21) Appl. No.: 12/053,190

(22) Filed: Mar. 21, 2008

(65) Prior Publication Data

US 2009/0238706 A1 Sep. 24, 2009

(51) Int. Cl.

| | |
|---|---|
| ***F01C 1/00*** | (2006.01) |
| ***F03C 2/00*** | (2006.01) |
| ***F03C 4/00*** | (2006.01) |
| ***F04C 2/00*** | (2006.01) |

(52) U.S. Cl. ..... 418/225; 418/1; 29/888.025

(58) Field of Classification Search ..... 418/1, 68, 418/133, 225–227, 270; 29/888.025
See application file for complete search history.

(56) References Cited

U.S. PATENT DOCUMENTS

| | | | | | |
|---|---|---|---|---|---|
| 2,335,284 | A | * | 11/1943 | Kendrick | 418/82 |
| 2,657,638 | A | * | 11/1953 | English | 418/225 |
| 2,737,121 | A | * | 3/1956 | Badalini | 418/225 |
| 3,316,852 | A | * | 5/1967 | Sadler | 418/225 |
| 3,373,693 | A | * | 3/1968 | McKittrick | 418/225 |
| 4,645,430 | A | | 2/1987 | Carleton | |

FOREIGN PATENT DOCUMENTS

| | | | | | |
|---|---|---|---|---|---|
| JP | 59196986 | A | * | 11/1984 | 418/225 |
| SU | 1752992 | A1 | * | 8/1992 | |

* cited by examiner

*Primary Examiner* — Theresa Trieu
(74) *Attorney, Agent, or Firm* — Merchant & Gould PC

(57) ABSTRACT

A rotary fluid device having a housing that defines a pumping chamber, a shaft disposed in the housing, and a rotor disposed in the pumping chamber and engaged with the shaft. The rotor includes a body which defines a bore that includes an oblique tapered surface. A pivot line is disposed along the tapered surface. The pivot line is a circumferential line at which the rotor pivots. A method for manufacturing a rotor includes turning an outer peripheral surface of the rotor. A bore is formed in the rotor. The bore includes an oblique tapered surface that has a pivot line disposed along the tapered surface, wherein the pivot line is a circumferential line at which the rotor pivots.

29 Claims, 8 Drawing Sheets

SELF-ALIGNING PUMP ROTOR AND METHODS

TECHNICAL FIELD

The present disclosure relates to fluid pumps, and more particularly, to fluid pumps having mechanical rotor assemblies.

BACKGROUND

Rotary fluid devices are used for a variety of purposes such as to transfer fluid (i.e., water, oil, etc.) from one location to another (e.g., a pump) or to convert fluid pressure into torque (e.g., a motor). Most rotary fluid devices include a rotating component. The rotating component cooperates with other components of the rotary fluid device to achieve its pumping or motoring purpose.

The rotating component includes precise dimensions and is precisely placed in the rotary fluid device. As a result of these precise dimensions and the precise placement of the rotating component in the rotary fluid device, assembly and disassembly of the rotary fluid device often requires the use of specialized tools. While specialized tools can be readily employed in a manufacturing facility, the use of specialized tools in the field makes field serviceability of the rotary fluid device very difficult. Therefore, there is a current need for an improved rotating component that does not require the use of special tools for assembly.

SUMMARY

An aspect of the present disclosure relates to rotary fluid device having a housing that defines a pumping chamber, a shaft disposed in the housing, and a rotor disposed in the pumping chamber and engaged with the shaft. The rotor includes a body which defines a bore that includes an oblique tapered surface. A pivot line is disposed along the tapered surface. The pivot line is a circumferential line at which the rotor pivots.

Another aspect of the present disclosure relates to a method for manufacturing a rotor. The method includes turning an outer peripheral surface of the rotor. A bore is formed in the rotor. The bore includes an oblique tapered surface that has a pivot line disposed along the tapered surface, wherein the pivot line is a circumferential line at which the rotor pivots.

Another aspect of the present disclosure relates to a method for assembling a rotary fluid device, the method includes installing a rotor over a shaft into a pumping chamber of a housing. The rotor defines a bore having an oblique tapered surface with a pivot line disposed along the tapered surface, wherein the pivot line is a circumferential line. An end plate defining a center opening is mounted to the housing. The end plate includes an outer race of a bearing disposed in the center opening for engaging the shaft.

Another aspect of the present disclosure relates to a rotor. The rotor includes a body which defines a bore that includes an oblique tapered surface. The tapered surface of the rotor includes a first taper portion and a second taper portion that intersect. A pivot line is disposed along the tapered surface at the intersection of the first taper portion and the second taper portion. The pivot line is a circumferential line at which the rotor pivots.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Many fluid pumps include rotating kits that transport or pump fluid from one location to another location. In order for these rotating kits to operate efficiently, small dimensional tolerances are required to minimize potential leakage between the rotating kits and the fluid pump. However, as a result of these small dimensional tolerances, the assembly of the rotating kit in the pump is difficult. The small dimensional tolerances require the rotating kit to be precisely placed within a pump chamber of the pump such that axial ends of the rotating kit do not contact surfaces adjacent to the rotating kit when the fluid pump is fully assembled. If the axial ends of the rotating kit contact the surfaces adjacent to the rotating kit, excessive wear of the rotating kit, decreased mechanical efficiency of the pump, and potential galling at the interface between the axial end of the rotating kit and the adjacent surface may result. As a result of these potential assembly issues, fluid pumps having rotating kits with small dimensional tolerances are not easily serviceable in the field as specialty tools for assembling the rotating kit in the pump chamber are often required.

In order to minimize the likelihood of contact between the axial ends of the rotating kit and the surfaces adjacent to the rotating kit, a self-aligning rotating kit will be described. The self-aligning rotating kit aligns itself in the pump chamber, which allows the rotating kit to be assembled and serviced in the field. In addition, the self-aligning feature of the rotating kit allows the rotor to be fitted within the pumping chamber without the need of expensive assembly tools and complicated assembly techniques, which allows for the self-aligning rotating kit to be less expensively and more efficiently manufactured and serviced.

Figure 1:
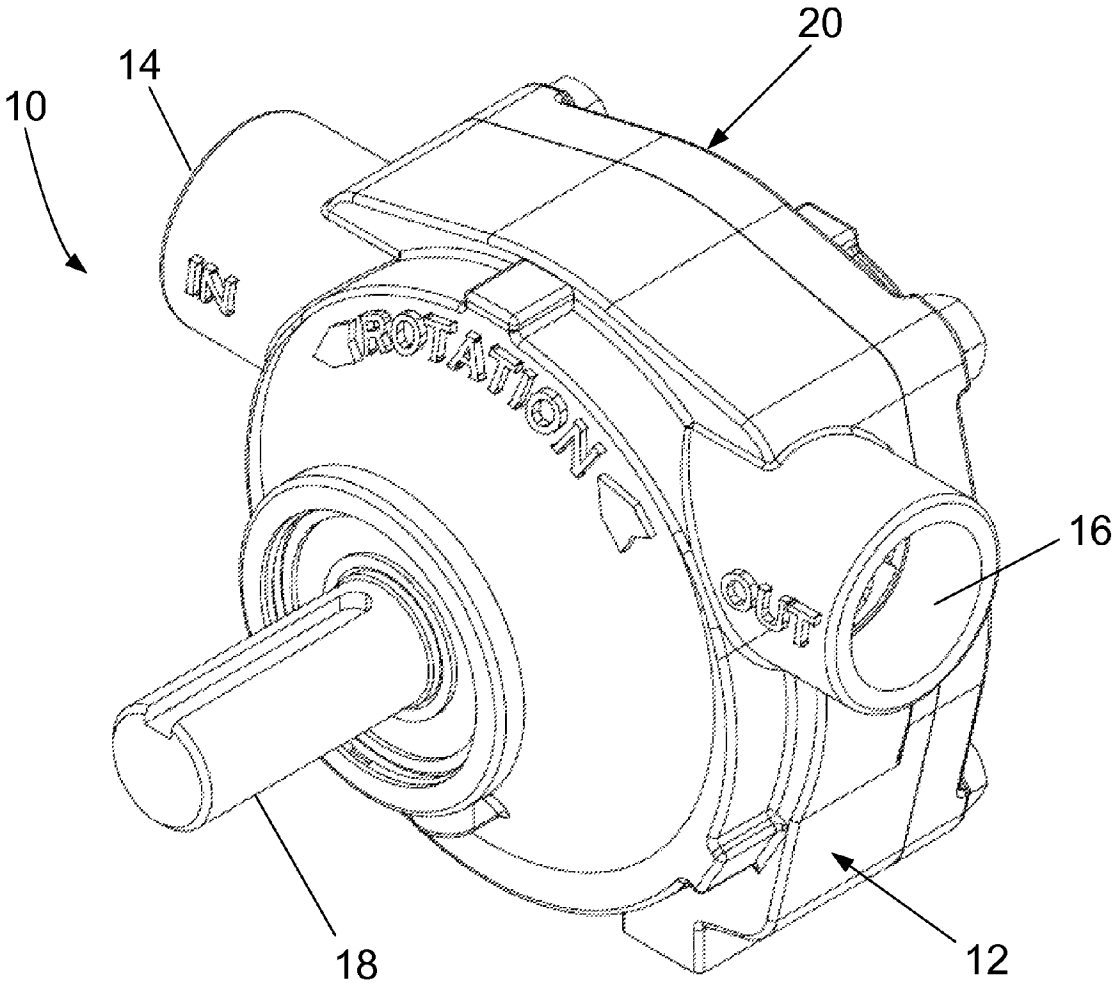
FIG. 1 is an isometric view of a rotary fluid device having exemplary features of aspects in accordance with the principles of the present disclosure.

Referring now to FIG. 1, a rotary fluid device, generally designated 10, is shown. For ease of description purposes, the rotary fluid device 10 will be described herein as a pump, and more particularly as a roller pump. It will be understood, however, that the scope of the present disclosure is not limited to the rotary fluid device 10 being a pump as the rotary fluid device 10 could also be a motor. It will also be understood that the scope of the present disclosure is not limited to the rotary fluid device 10 being a roller pump, as the rotary fluid device 10 could also include, but not be limited to, a vane pump and an impeller pump.

In the subject embodiment, the rotary fluid device 10 includes a housing, generally designated 12, having a fluid inlet 14 and a fluid outlet 16. The rotary fluid device 10 further includes a shaft 18 and an end plate, generally designated 20, connectedly engaged with the housing 12.

Figure 2:
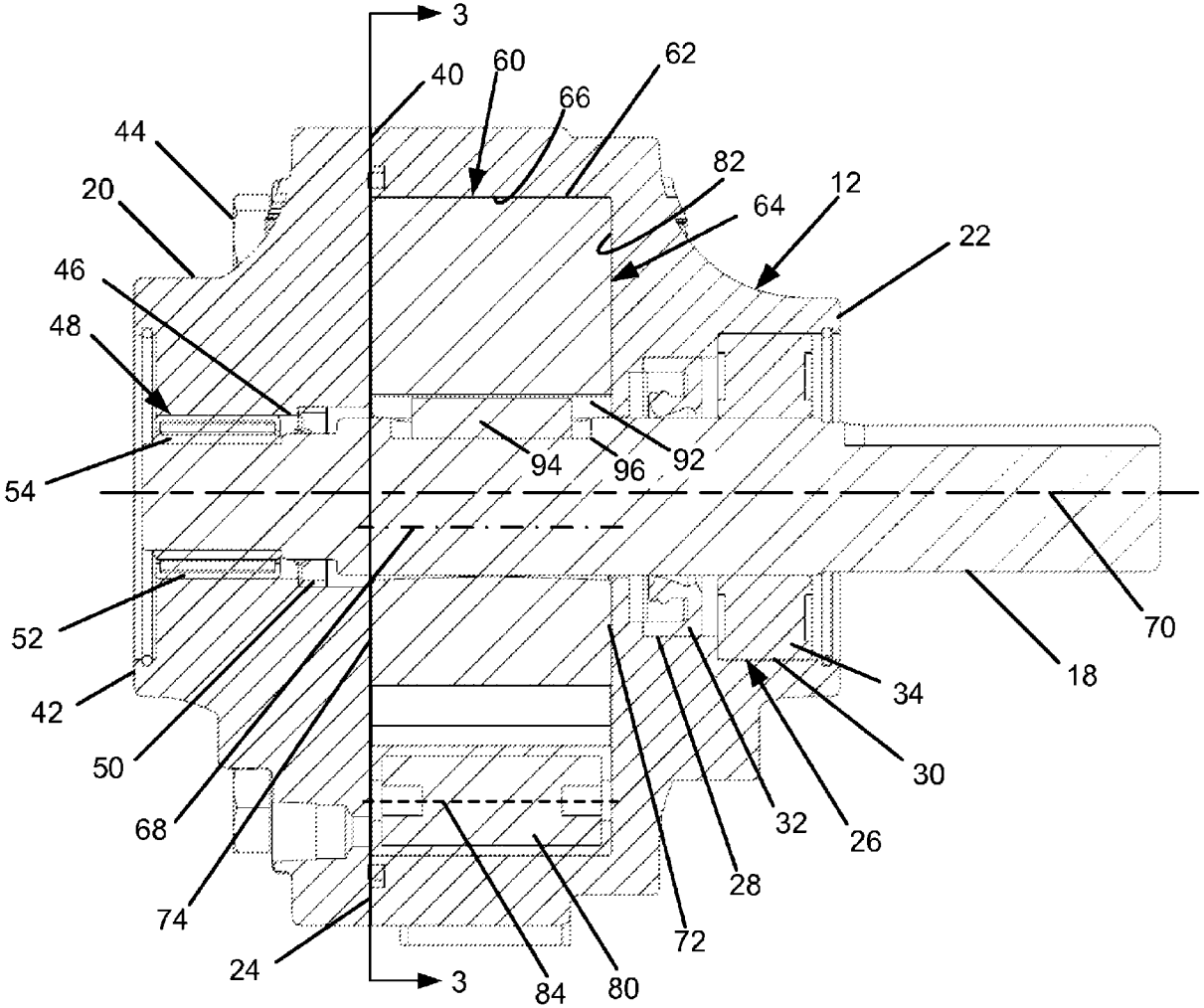
FIG. 2 is a cross-section view of the rotary fluid device of FIG. 1 taken on line 2-2 of FIG. 1.
Figure 3:
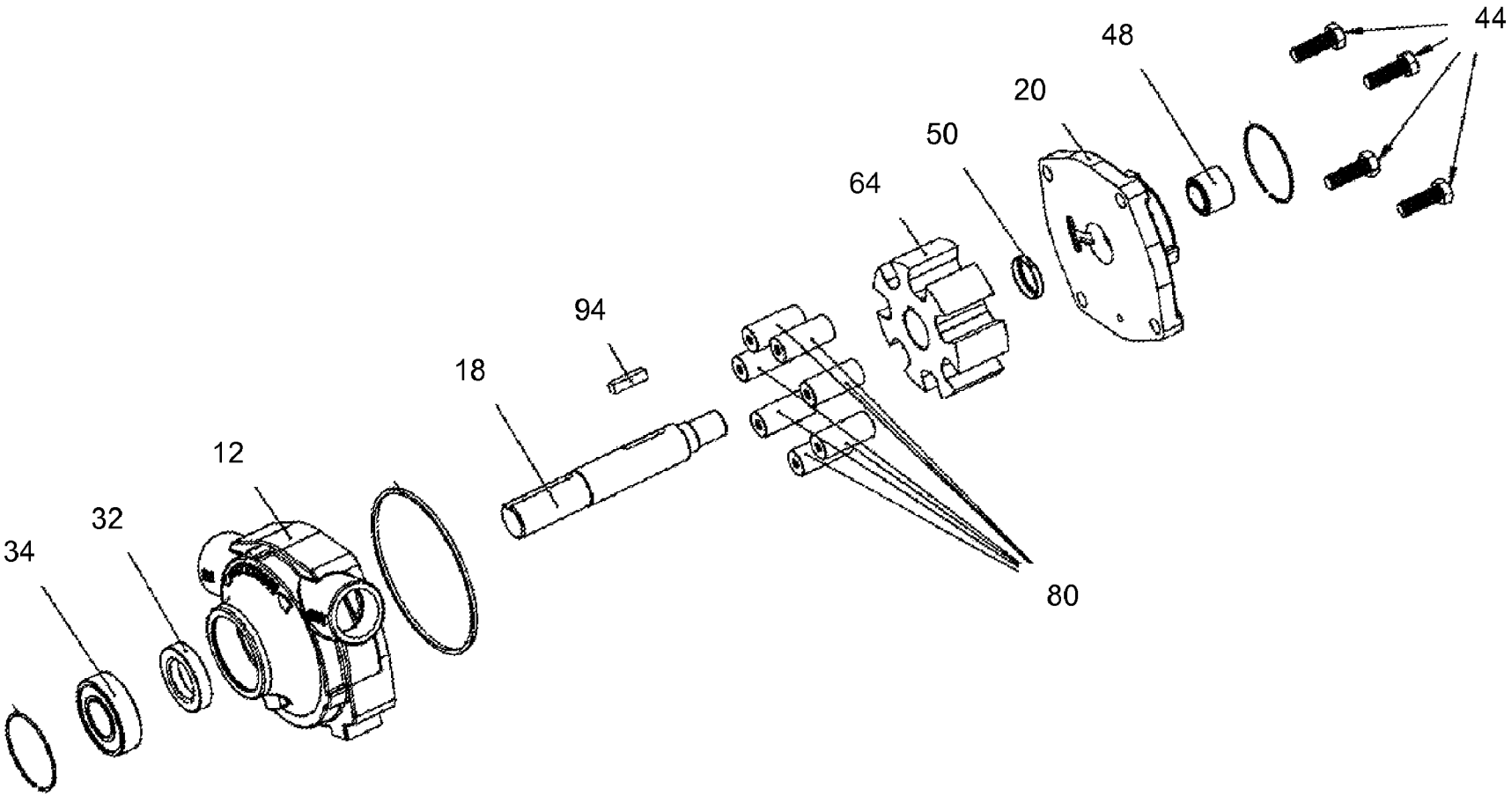
FIG. 3 is an exploded isometric view of the rotary fluid device of FIG. 1.

Referring now to FIGS. 2 and 3, a cross-sectional view and an exploded view of the rotary fluid device 10 are shown. The housing 12 of the rotary fluid device 10 includes a first end 22 and an oppositely disposed second end 24. The first end 22 defines a stepped bore, generally designated 26, having a first portion 28 and a second portion 30 with the first and second portions 28, 30 being concentrically oriented. In the subject embodiment, an inner diameter of the first portion 28 is smaller than an inner diameter of the second portion 30.

The first portion 28 of the stepped bore 26 is adapted to receive a radial lip seal 32. In the subject embodiment, the radial lip seal 32 is retained in the first portion 28 of the stepped bore 26 through a press-fit/friction-fit engagement.

The second portion 30 of the stepped bore 26 is adapted to receive a first bearing set 34. In the subject embodiment, the first bearing set 34 is a ball bearing. It will be understood, however, that the scope of the present disclosure is not limited to the first bearing set 34 being a ball bearing. The first bearing set 34 is retained in the second portion 30 of the stepped bore 26 through a press-fit/friction-fit engagement.

The end plate 20 of rotary fluid device 10 includes a first end surface 40 and a second end surface 42. The end plate 20 is connectedly engaged with the housing 12 through a plurality of fasteners 44. In the subject embodiment, the fasteners 44 provide tight sealing engagement between the first end surface 40 of the end plate 20 and the second end 24 of the housing 12. It will be understood, however, that the scope of the present disclosure is not limited to the first end surface 40 of the end plate 20 being engaged to the second end 24 of the housing 12 as there could be additional plates, such as wear plates or spacer plates, or rotating kits disposed between the end plate 20 and the housing 12.

In the subject embodiment, the end plate 20 defines a center bore 46 that extends from the first end surface 40 through the second end surface 42 of the end plate 20. Disposed within the center bore 46 is a second bearing set, generally designated 48, and a lip seal 50. In the subject embodiment, the second bearing set 48 is a needle bearing having an outer race 52 and an inner race 54. The outer race 52 of the second bearing set 48 is retained in the center bore 46 through a press-fit/friction-fit engagement. The inner race 54 of the second bearing set 48 is retained on the shaft 18 through a press-fit/friction fit engagement. It will be understood, however, that the scope of the present disclosure is not limited to the second bearing set 48 having an inner race 54 as the shaft 18 can be manufactured to the hardness and surface finish requirements for the second bearing set 48.

Figure 4:
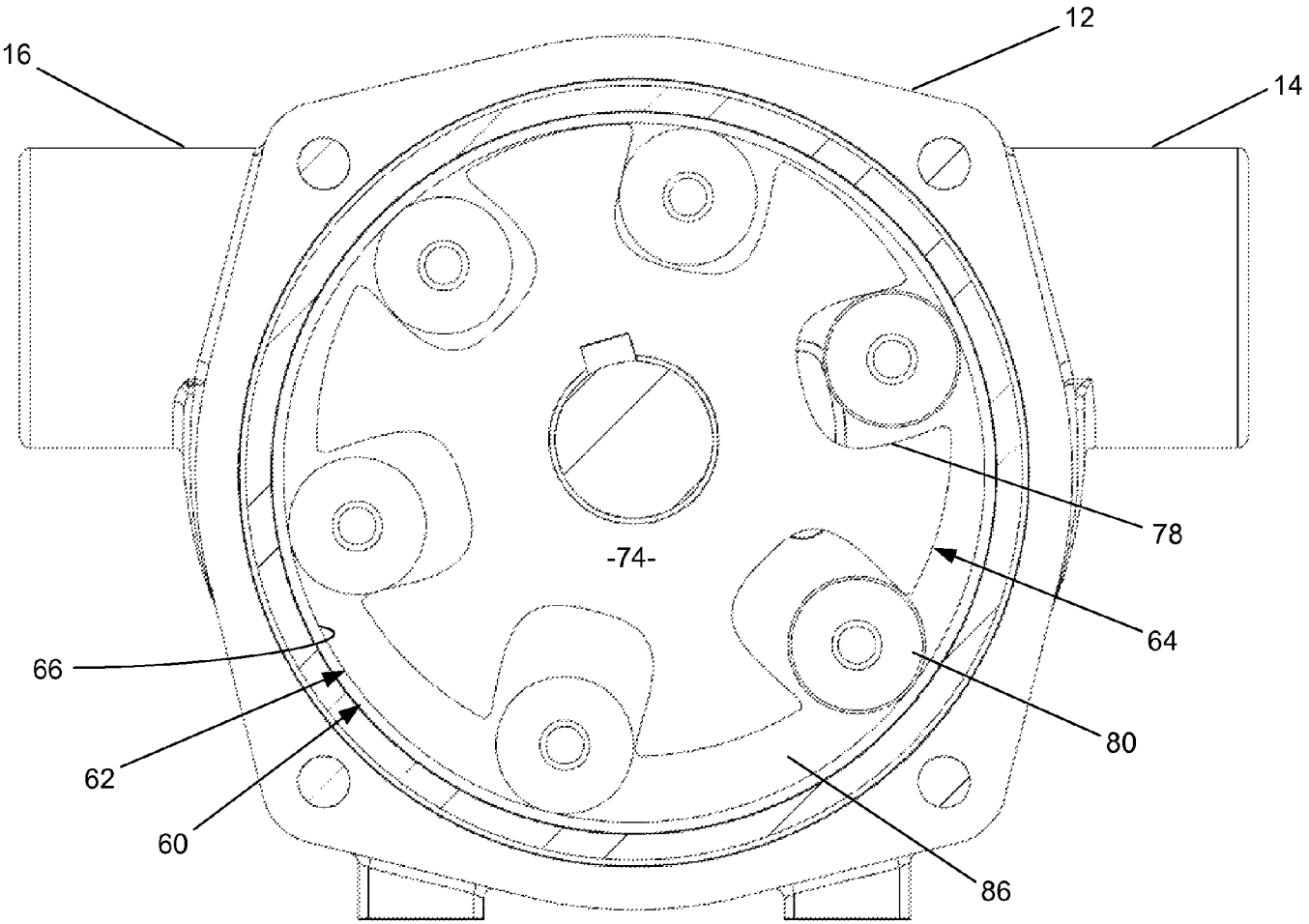
FIG. 4 is an exemplary view of a rotor assembly having exemplary features of aspects in accordance with the principles of the present disclosure.
Figure 5:
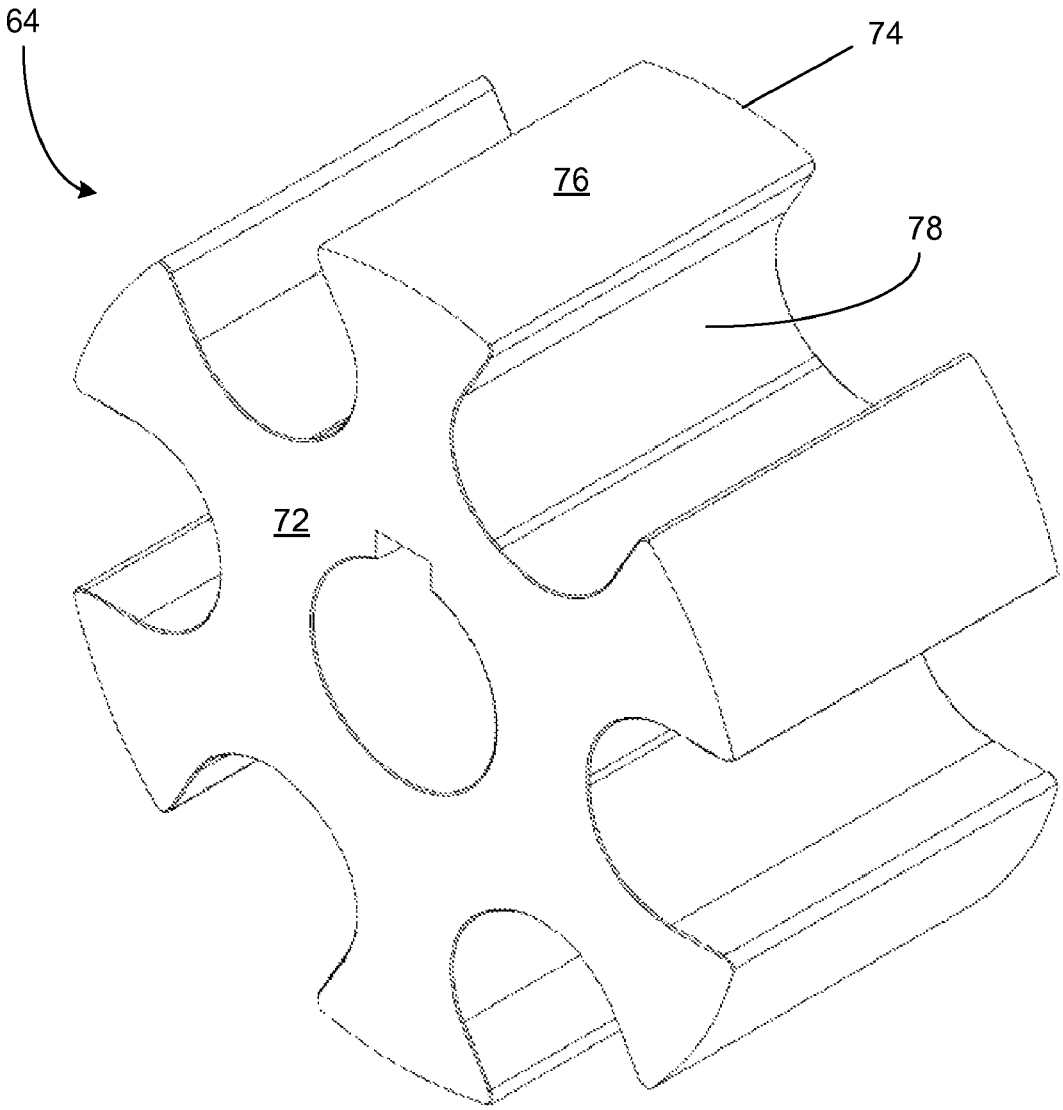
FIG. 5 is an isometric view of a rotor of the rotor assembly of FIG. 4.

Referring now to FIGS. 2-4, a rotor assembly, generally designated 60, will be described. The rotor assembly 60 includes a pumping chamber 62 and a rotor, generally designated 64.

In the subject embodiment, the second end 24 of the housing 12 defines the pumping chamber 62. It will be understood, however, that the scope of the present disclosure is not limited to the housing 12 defining the pumping chamber 62. In the subject embodiment, the pumping chamber 62 defines an inner surface 66 that is generally cylindrical in shape. It will be understood, however that the scope of the present disclosure is not limited to the inner surface 66 of the pumping chamber 62 being cylindrical in shape as the inner surface 66 could have a cam-shaped surface, which is similar to the inner surface of a vane-type pump.

The pumping chamber 62 defines a longitudinal axis 68 (shown as a dashed and dotted line in FIG. 2). In the subject embodiment, the longitudinal axis 68 of the pumping chamber 62 is eccentrically offset from a central axis 70 (shown as a dashed line in FIG. 2) defined by the rotary fluid device 10.

Referring now to FIGS. 2-6, the rotor 64 includes a first axial end 72 and an oppositely disposed second axial end 74. The rotor 64 further includes an outer peripheral surface 76 (shown in FIG. 5). The outer peripheral surface 76 defines a plurality of slots 78 with each of the slots 78 adapted to receive a roller 80.

The rotor 64 is rotatably disposed in the pumping chamber 62 such that the first axial end 72 is adjacent to an end wall 82 of the housing 12 and the second axial end 74 is adjacent to the first end surface 40 of the end plate 20. In the subject embodiment, the rotor 64 rotates about an axis 83 (shown in FIG. 7) that is generally aligned with the central axis 70 of the rotary fluid device 10.

During rotation of the rotor 64 about the axis 83, which is generally aligned with the central axis 70 of the rotary fluid device 10, each of the rollers 80 rotates about a center axis 84 (shown as a dashed line in FIG. 2) defined by the roller 80 and revolves about the central axis 70. As the rotor 64 rotates within the pumping chamber 62, each roller 80 is in rolling engagement with the inner surface 66 of the pumping chamber 62.

In the subject embodiment, the inner surface 66 of the pumping chamber 62, the rotor 64, and the rollers 80 cooperatively define a plurality of contracting and expanding volume chambers 86. As the rotor 64 rotates about the central axis 70, the expanding volume chambers 86 are in fluid communication with the fluid inlet 14 of the fluid rotary device 10 while the contracting volume chambers 86 are in fluid communication with the fluid outlet 16.

Figure 6:
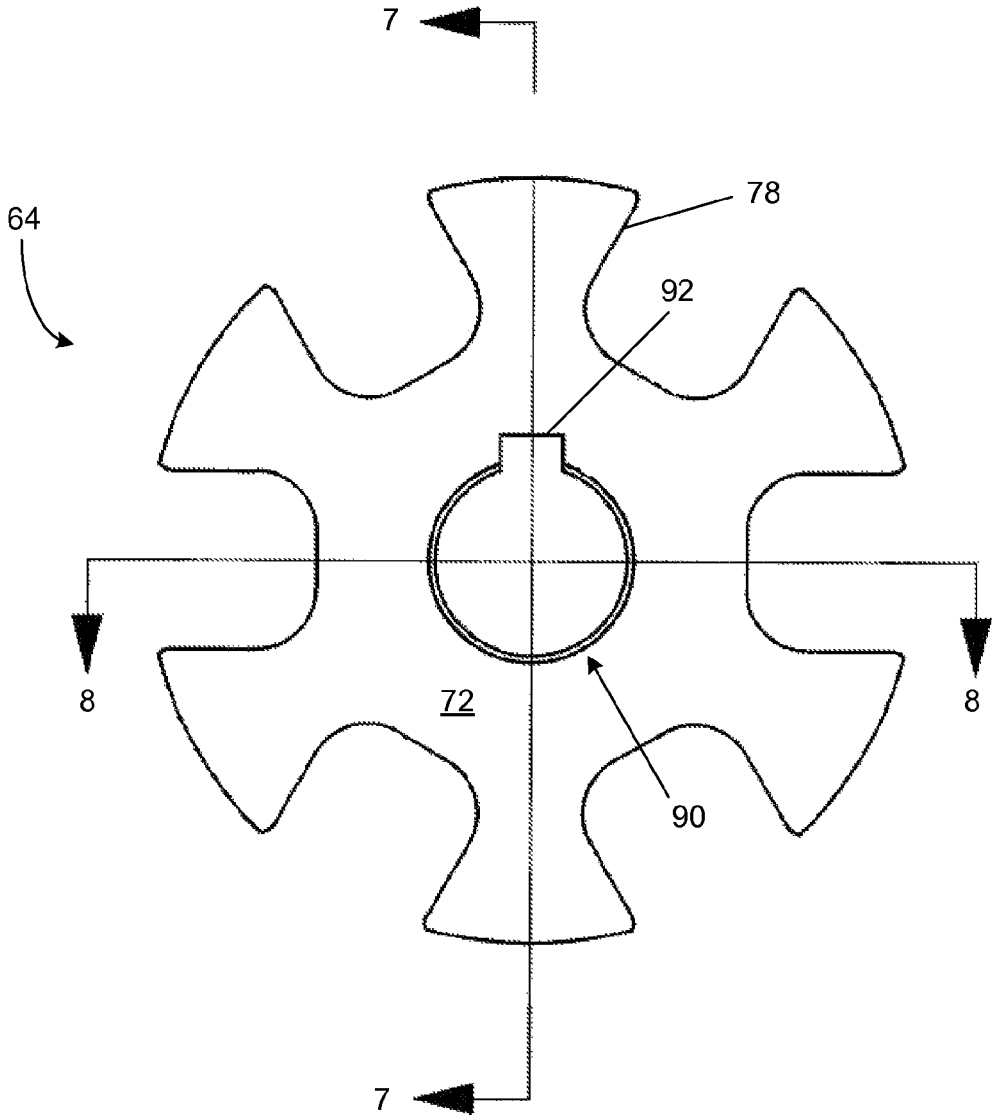
FIG. 6 is a front view of the rotor of FIG. 5.
Figure 7:
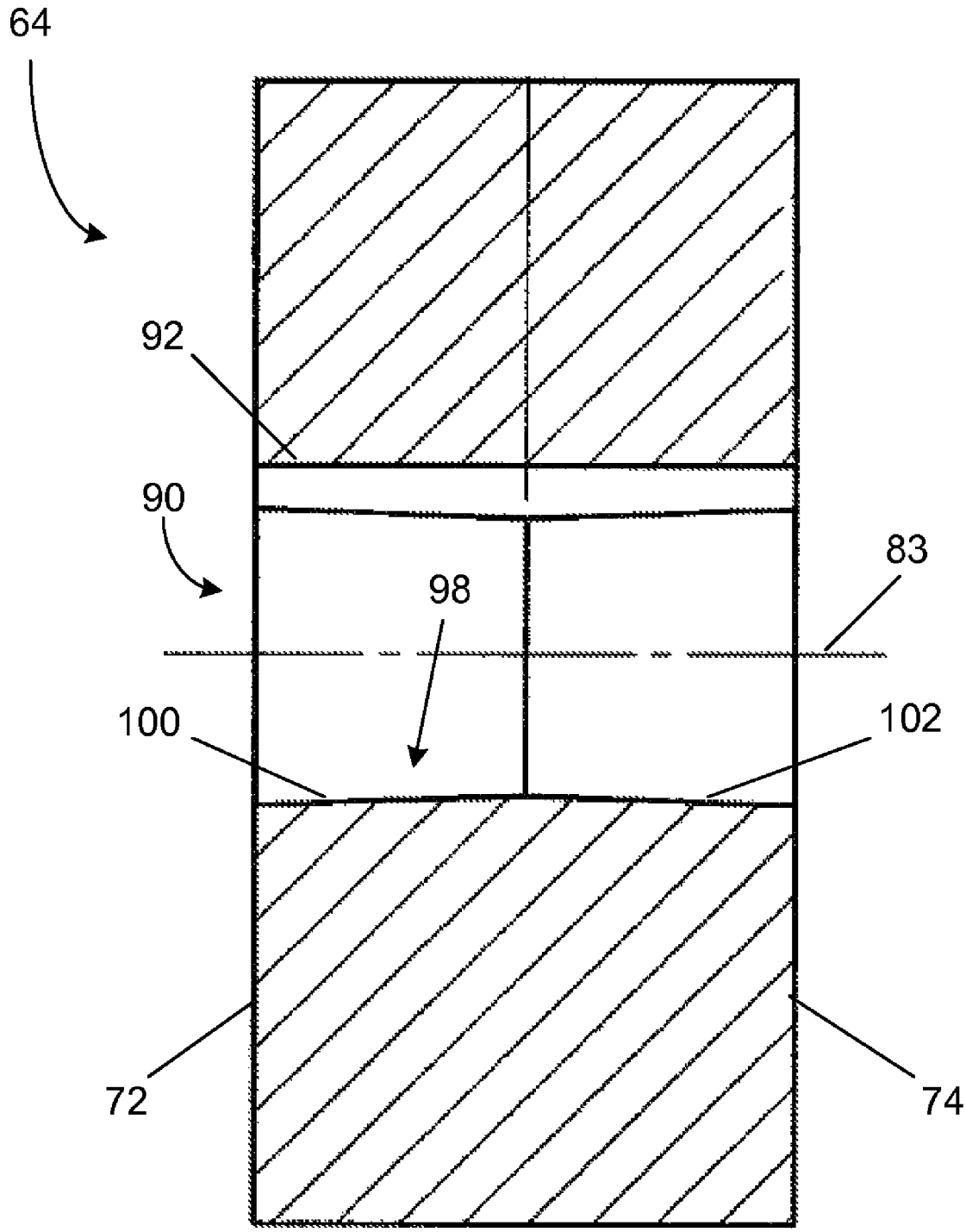
FIG. 7 is a cross-sectional view of the rotor of FIG. 5 taken on line 7-7 of FIG. 6.

Referring now to FIGS. 6 and 7, the rotor 64 defines a central bore, generally designated 90, that extends through the first axial end 72 and the second axial end 74. In the subject embodiment, the central bore 90 is sized such that the central bore 90 can receive the shaft 18. The central bore 90 defines a notch 92 that is adapted to receive a key 94 (shown in FIG. 2), which is engaged in a groove 96 (shown in FIG. 2) defined by the shaft 18. In the subject embodiment, and by way of example only, the central bore 90 defines one notch 92, which is rectangular in shape. The disposition of the key 94 in the notch 92 of the rotor 64 allows the shaft 18 and rotor 64 to rotate unitarily.

Figure 8:
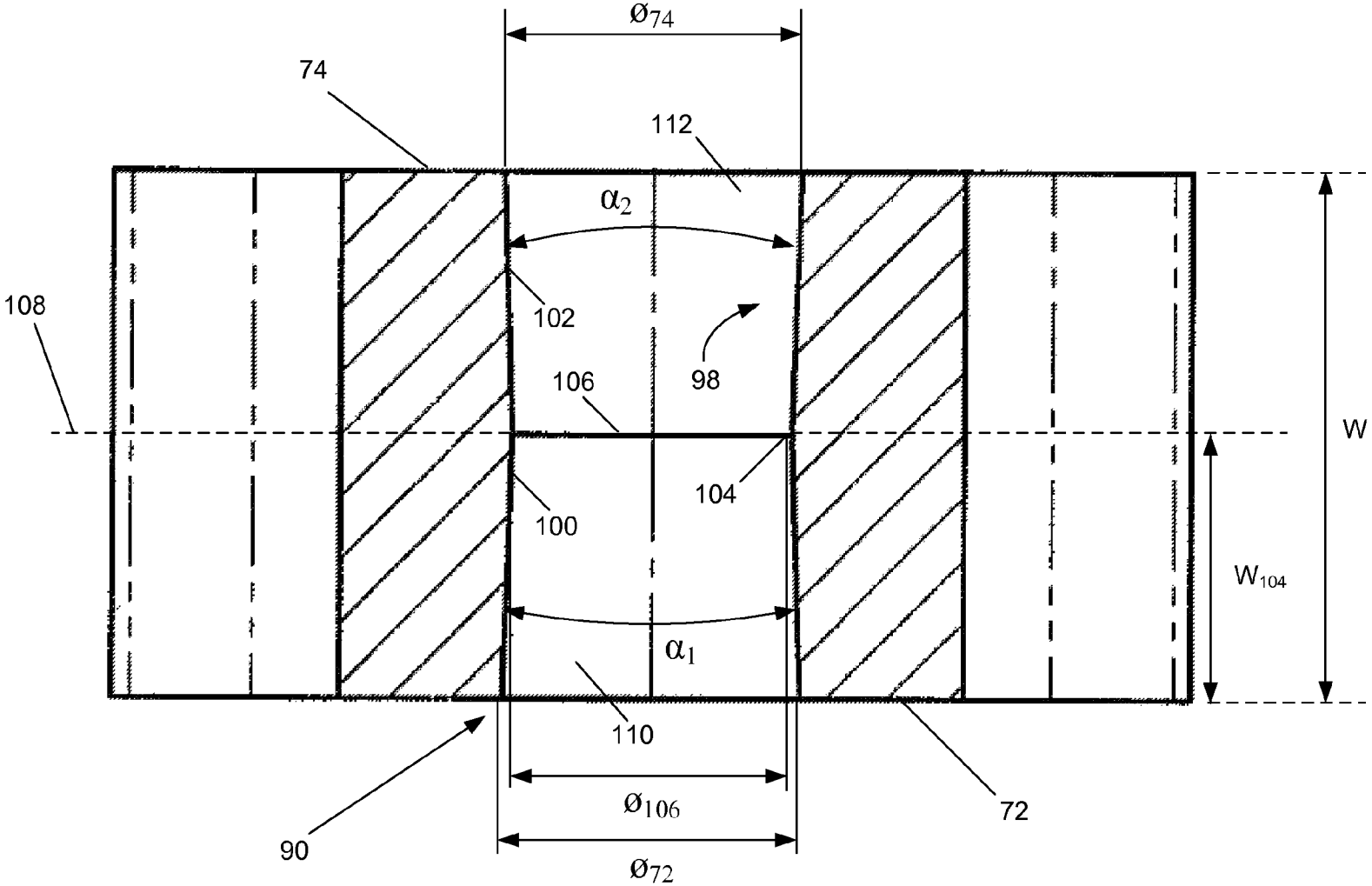
FIG. 8 is a cross-section view of the rotor of FIG. 5 taken on line 8-8 of FIG. 6.

Referring now to FIGS. 7 and 8, the central bore 90 includes an oblique tapered surface, generally designated 98. In the subject embodiment, the tapered surface 98 extends from the first axial end 72 of the rotor 64 to the second axial end 74. In the depicted embodiment, the tapered surface 98 includes a first taper portion 100 and a second taper portion 102. The first taper portion 100 extends from the first axial end 72 of the rotor 64 to an axial location 104. The second taper portion 102 extends from the second axial end 74 of the rotor 64 to the axial location 104. In the subject embodiment, the intersection of the first taper portion 100 and the second taper portion 102 at the axial location 104 defines a pivot line 106. The pivot line 106 is a circumferential line having an inner diameter $Ø_{106}$ that is less than the inner diameter of the remaining tapered surface 98. In the subject embodiment, the pivot line 106 is disposed in a plane 108 that is generally parallel to the first and second axial ends 72, 74 of the rotor 64.

In the subject embodiment, the axial location 104 of the pivot line 106 is disposed an axial distance $W_{104}$ from the first axial end 72. This axial distance $W_{104}$ is less than or equal to the total width W of the rotor 64 as measured from the first axial end 72 to the second axial end 74. In the subject embodiment, and by way of example only, the axial distance $W_{104}$ is in the range of about 0% to about 100% of the width W of the rotor 64. In another embodiment, and by way of example only, the axial distance $W_{104}$ is in the range of about 25% to about 75% of the width W of the rotor 64. In another embodiment, and by way of example only, the axial distance $W_{104}$ is in a range of about 33% to about 67% of the width W of the rotor 64. In another embodiment, and by way of example only, the axial distance $W_{104}$ is in a range of about 45% to about 55% of the width W of the rotor 64. In another embodiment, and by way of example only, the axial distance $W_{104}$ is in a range of about 48% to about 52% of the width W of the rotor 64. In another embodiment, and by way of example only, the axial distance $W_{104}$ is about 50% of the width W of the rotor 64.

The first taper portion 100 includes an inner diameter $Ø_{72}$ at the first axial end 72 of the rotor 64. As the first taper portion 100 extends along the axis 83 from the first axial end 72 to the axial location 104, the inner diameter $Ø_{72}$ of the first taper portion 100 decreases to the inner diameter $Ø_{106}$ of the pivot line 106. In the subject embodiment, the first taper portion 100 is shaped generally as a truncated right circular cone. It will be understood, however, that the scope of the present disclosure is not limited to the first taper portion 100 being generally conical in shape.

The second taper portion 102 includes an inner diameter $Ø_{74}$ at the second axial end 74 of the rotor 64. As the second taper portion 102 extends along the axis 83 from the second axial end 74 to the axial location 104, the inner diameter $Ø_{74}$ of the second taper portion 102 decreases to the inner diameter $Ø_{106}$ of the pivot line 106. In the subject embodiment, the second taper portion 102 is shaped generally as a truncated right circular cone. It will be understood, however, that the scope of the present disclosure is not limited to the second taper portion 102 being generally conical in shape.

In the subject embodiment, and by way of example only, the inner diameter $Ø_{72}$ of the first axial end 72 of the rotor 64 is about equal to the inner diameter $Ø_{74}$ of the second axial end 74. It will be understood, however, that the scope of the present disclosure is not limited to the inner diameter $Ø_{72}$ of the first axial end 72 being about equal to the inner diameter $Ø_{74}$ of the second axial end 74.

The inner diameter $Ø_{106}$ of the pivot line 106 is sized for a close clearance fit with the outer diameter of the shaft 18. This close clearance fit prevents the rotor 64 from moving radially with respect to the shaft 18 during rotation of the rotor 64 and the shaft 18.

In the subject embodiment, the first taper portion 100 defines a first conical opening 110 having a first conical angle $\alpha_1$. The first conical angle $\alpha_1$ is defined as the angle between the two lines that generate the truncated right circular conical shape of the first taper portion 100. In the subject embodiment, and by way of example only, the first conical angle $\alpha_1$ is in the range of about 0.1 to about 30 degrees. In one embodiment, and by way of example only, the first conical angle $\alpha_1$ is in the range of about 3 to about 5 degrees. In another embodiment, the first conical angle $\alpha_1$ is about 4 degrees.

The second taper portion 102 defines a second conical opening 112 having a second conical angle $\alpha_2$. The second conical angle $\alpha_2$ is defined as the angle between the two lines that generate the truncated right circular conical shape of the second taper portion 102. In the subject embodiment, and by way of example only, the second conical angle $\alpha_2$ is in the range of about 0.1 to about 30 degrees. In one embodiment, and by way of example only, the second conical angle $\alpha_2$ is in the range of about 3 to about 5 degrees. In another embodiment, the second conical angle $\alpha_2$ is about 4 degrees.

In the subject embodiment, the first conical angle $\alpha_1$ of the first taper portion 100 is about equal to the second conical angle $\alpha_2$ of the second taper portion 102. It will be understood, however, that the scope of the present disclosure is not limited to the first conical angle $\alpha_1$ of the first taper portion 100 being about equal to the second conical angle $\alpha_2$ of the second taper portion 102.

With the inner diameter $Ø_{106}$ of the pivot line 106 being in close clearance fit with the shaft 18 and with the inner diameters $Ø_{72}$, $Ø_{74}$ of the first and second taper portions 100, 102 at the first and second axial ends 72, 74, respectively, being larger than the inner diameter $Ø_{104}$ of the axial location 104, the central bore 90 of the rotor 64 allows for angular misalignment of the rotor 64 on the shaft 18. As will be described in greater detail subsequently, this allowance for angular misalignment provides for ease of assembly/reassembly of the rotary fluid device 10.

Referring now to FIGS. 5-8, a method for manufacturing the rotor 64 will now be described. The rotor 64 is formed from a piece of raw stock such as steel or powdered metal. The raw stock may include a hole disposed near the axial center of the raw stock and having an inner diameter that is smaller than the inner diameter at the axial location 104. Locating off of the hole, the raw stock is turned (i.e., lathe cut) to form the outer peripheral surface 76 of the rotor 64. With the outer periphery turned, the slots 78 can be formed using drills, end mills, or combinations thereof. A lathe is used to form the tapered surface 98 of the central bore 90. In one embodiment, the lathe cuts the first taper portion 100. In another embodiment, the lathe cuts the first taper portion 100 and the second taper portion 102. As the pivot line 106 is a circumferential line rather than a circumferential surface, the axial location 104 of the pivot line 106 does not require small dimensional tolerances. As small dimensional tolerances are not required, the pivot line 106 can be less expensively and more efficiently manufactured.

With the tapered surface 98 of the central bore 90 formed, a key broach is used to broach the notch 92. In one embodiment, after the notch 92 has been broached, the rotor 64 is ready to be assembled in the rotary fluid device 10. In another embodiment, after the notch 92 has been broached, the rotor 64 is heat treated. Following the heat treat process, the rotor 64 is sent to a grinding operation where the outer periphery, the slots 78, and the first and second axial ends 72, 74 of the rotor 64 are ground.

Referring now to FIGS. 2-4, and 8, the assembly of the rotary fluid device 10 will be described. The radial lip seal 32 is pressed into the first portion 28 of the stepped bore 26 in the housing 12. With the first bearing set 34 engaged to the shaft 18, the shaft 18 is inserted into the stepped bore 26 such that the first bearing set 34 is in tight-fit engagement with the second portion 30 of the stepped bore.

The key 94 is then inserted into the groove 96 of the shaft 18. With the key 94 disposed in the groove 96 of the shaft 18, the rotor 64 is inserted into the pumping chamber 62 such that the first axial end 72 of the rotor 64 is adjacent to the end wall 82 of the housing 12 and the notch 92 is engaged with the key 94. As previously stated, the central bore 90 of the rotor 64 allows for angular misalignment. Therefore, the axis 83 of the rotor 64 does not need to be precisely aligned with the central axis 70 of the rotary fluid device 10 when the rotor 64 is inserted into the pumping chamber 62 of the housing 12. As the inner diameter $Ø_{106}$ of the pivot line 106 is in close clearance fit with the outer diameter of the shaft 18 and as the inner diameters $Ø_{72}$, $Ø_{74}$ of the first and second axial ends 72, 74 of the rotor 64 are greater than the inner diameter $Ø_{106}$ of the pivot line 106, the rotor 64 is free to pivot at pivot point disposed along the pivot line 106 and/or points disposed within an area outlined by the pivot line 106. As the pivot line 106 is disposed in the plane 108, which is normal to the plane of rotation, the phrases "pivot at the pivot line 106", "line at which the rotor pivots", and derivatives thereof, as used in the specification and the claims will be understood to mean that the rotor pivots at pivot points disposed along the pivot line 106 and/or pivot points within an area outlined by the pivot line 106. In the subject embodiment, the rotor 64 can pivot at the pivot line 106 by about one-half the first conical angle $\alpha_1$ or about one-half the second conical angle $\alpha_2$ depending on which conical angle is smaller.

If the rotor 64 is angularly misaligned from the central axis 70 during installation, engagement of the end plate 20 to the housing 12 will pivot the rotor 64 at the pivot line 106 so as to rotationally balance the rotor 64 in the pumping chamber 62. In the subject embodiment, and by way of example only, the engagement of the end plate 20 to the housing 12 pivots the rotor 64 such that the axis 83 of the rotor 64 is generally aligned with the central axis 70.

With the rotor 64 disposed in the pumping chamber 62, the rollers 80 are inserted into the slots 78 defined by the rotor 64. The end plate 20 having the lip seal 50 and the outer race 52 of the second bearing set 48 disposed in the center bore 46 is mounted to the housing 12 such that the shaft 18 extends through the center bore 46. The fasteners 44 are then inserted through the end plate 20 and into the housing 12 and tightened to a predetermined torque.

The tapered surface 98 of the central bore 90 of the rotor 64 allows the rotor 64 to be self-aligning. This feature is potentially advantageous as it provides for improved assembly/reassembly of the rotary fluid device 10, which improves the serviceability of the rotary fluid device 10. As assembly/reassembly of the rotor 64 does not require the use of precision tools to properly align the axis 83 of the rotor 64 to the central axis 70 of the rotary fluid device 10, the rotary fluid device 10 can be easily disassembled and reassembled in the field.

In addition, the pivot line 106 of the tapered surface 98 can minimize the amount of wear between the rotor 64 and the shaft 18. As the pivot line 106 of the tapered surface 98 is a circumferential line, as opposed to a circumferential surface, the pivoting of the rotor 64 at the pivot line 106 minimizes wear between the pivot line 106 and the shaft 18. Wear resulting from the interfacing of mating or adjacent components creates material particles or contaminants. These material particles can create detrimental effects (e.g., galling, seizing, etc.) in the rotary fluid device 10 due to the tolerances associated with the assembly of the rotary fluid device 10. By having the pivot line 106 formed as a circumferential line as opposed to a surface, the amount of wear is reduced as the pivoting of the rotor 64 at the pivot line 106 does not create interference between the shaft 18 and the pivot line 106.

As previously stated, the second bearing set 48 includes an outer race 52 disposed in the center bore 46 of the end plate 20 and an inner race 54 disposed on the shaft 18. The outer and inner races 52, 54 of the second bearing set 48 are engaged such that the inner race 54 rotates within the outer race 52. As the outer and inner races 52, 54 are not in tight-fit engagement with each other, the outer and inner races 52, 54 can be separated without the use of a hydraulic press. This feature is potentially advantageous as it provides access to the rotor assembly 60 without the need for specialized tools.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A rotary fluid device comprising:
a housing defining a pumping chamber;
a shaft disposed in the housing;
a rotor disposed in the pumping chamber of the housing and connectedly engaged with the shaft, the rotor having a body;
a bore defined by the body and including an oblique tapered surface; and
a pivot line disposed along the tapered surface, wherein the pivot line is a continuous circumferential edge at which the rotor pivots.

2. A rotary fluid device as claimed in claim 1, wherein the tapered surface of the rotor includes a first taper portion and a second taper portion that intersect, the intersection of the first taper portion and the second taper portion forming the pivot line.

3. A rotary fluid device as claimed in claim 2, wherein the first taper portion extends from a first axial end of the rotor to an axial location of the pivot line.

4. A rotary fluid device as claimed in claim 3, wherein the second taper portion extends from a second axial end of the rotor to the axial location of the pivot line.

5. A rotary fluid device as claimed in claim 4, wherein an inner diameter of the bore at the first axial end of rotor is about equal to the inner diameter of the bore at the second axial end of the rotor.

6. A rotary fluid device as claimed in claim 2, wherein the first taper portion defines a first conical angle and the second taper portion defines a second conical angle.

7. A rotary fluid device as claimed in claim 6, wherein the first and second conical angles are in the range of 0.1 to 30 degrees.

8. A rotary fluid device as claimed in claim 6, wherein the first and second conical angles are 4 degrees.

9. A rotary fluid device as claimed in claim 6, wherein the first and second conical angles are generally equal.

10. A rotary fluid device as claimed in claim 1, wherein the body of the rotor defines a plurality of slots with each slot being adapted for engagement with a pumping element.

11. A rotary fluid device as claimed in claim 10, wherein the pumping element is a roller.

12. A rotary fluid device as claimed in claim 1, wherein the bore includes one notch that extends from a first axial end of the rotor through a second axial end of the rotor, and wherein the pivot line extends from one side of the notch to an opposite side of the notch.

13. A rotary fluid device as claimed in claim 12, wherein a key is engaged with the notch in the bore of the rotor and the shaft.

14. A rotary fluid device as claimed in claim 1, wherein an axial distance from a first axial end of the rotor to the pivot line is 25% to about 75% of an axial distance from the first axial end to a second axial end of the rotor.

15. A rotary fluid device as claimed in claim 1, wherein an axial distance from a first axial end of the rotor to the pivot line is 50% of an axial distance from the first axial end to a second axial end.

16. A rotary fluid device as claimed in claim 1, further comprising a bearing having an inner race engaged with the shaft and an outer race engaged in a center bore of an end plate that is connectedly engaged with the housing.

17. A rotary fluid device as claimed in claim 1, wherein the pivot line extends circumferentially around more than one half of the bore.

18. A method for manufacturing a rotor, the method comprising:

turning an outer peripheral surface of the rotor;

forming a bore in the rotor, the bore including an oblique tapered surface that has a pivot line disposed along the tapered surface, wherein the pivot line is a continuous circumferential edge at which the rotor pivots.

19. A method for manufacturing a rotor as claimed in claim 18, wherein the tapered surface includes a first taper portion and a second taper portion that intersect, the intersection of the first taper portion and the second taper portion forming the pivot line.

20. A method for manufacturing a rotor as claimed in claim 18, wherein the pivot line extends circumferentially around more than one half of the bore.

21. A method for assembling a rotary fluid device, the method comprising:

installing a rotor over a shaft and into a pumping chamber of a housing, the rotor defining a bore having an oblique tapered surface with a pivot line disposed along the tapered surface, wherein the pivot line is a continuous circumferential edge; and mounting an end plate defining a center opening to the housing, wherein the end plate includes an outer race of a bearing disposed in the center opening for engaging the shaft.

22. A method for assembling a rotary fluid device as claimed in claim 21, wherein the shaft includes an inner race that engages the outer race when the end plate is engaged with the housing.

23. A method for assembling a rotary fluid device as claimed in claim 21, wherein the pivot line extends circumferentially around more than one half of the bore.

24. A rotor comprising:

a body;

a bore defined by the body and including an oblique tapered surface, wherein the tapered surface of the rotor includes a first taper portion and a second taper portion that intersect; and a pivot line disposed along the tapered surface at the intersection of the first taper portion and the second taper portion, wherein the pivot line is a continuous circumferential edge at which the rotor pivots.

25. A rotor as claimed in claim 24, wherein the body of the rotor defines a plurality of slots with each slot being adapted for engagement with a pumping element.

26. A rotor as claimed in claim 25, wherein the pumping element is a roller.

27. A rotor as claimed in claim 25, wherein the pivot line extends circumferentially around more than one half of the bore.

28. A rotor as claimed in claim 24, wherein the bore includes one notch that extends from a first axial end of the rotor through a second axial end of the rotor, and wherein the pivot line extends from one side of the notch to an opposite side of the notch.

29. A rotor as claimed in claim 24, wherein the first taper portion extends from a first axial end of the rotor to an axial location of the pivot line and the second taper portion extends from a second axial end of the rotor to the axial location of the pivot line.

* * * * *